US005883325A

United States Patent [19]

Peirce

[11] Patent Number: 5,883,325

[45] Date of Patent: Mar. 16, 1999

[54] MUSICAL INSTRUMENT

[76] Inventor: Mellen C. Peirce, 51 Kelly Street, London, England, NW1 8 PG

[21] Appl. No.: 963,652

[22] Filed: Nov. 3, 1997

[51] Int. Cl.[6] ..... G10H 1/00; G10H 7/00

[52] U.S. Cl. ..... 84/615; 84/602; 84/616; 84/622; 84/609

[58] Field of Search ..... 84/601–602, 604–606, 84/615–616, 622–627, 609–610, 649–650, 477 R, 478, 485 R, 709

[56] References Cited

U.S. PATENT DOCUMENTS 4,939,975 7/1990 Sakashita ..... 84/626
5,392,682 2/1995 McCartney-Hoy ..... 84/470 R
5,619,003 4/1997 Hotz ..... 84/615
5,723,802 3/1998 Johnson et al. ..... 84/609

*Primary Examiner*—Stanley J. Witkowski
*Assistant Examiner*—Marlon T. Fletcher
*Attorney, Agent, or Firm*—Robert K. Tendler

[57] ABSTRACT

A musical instrument comprises a plurality of keys (10–19), a processor means (20) connected to said keys and arranged to provide an output signal to be utilized in the generation of notes. A data storage means (22) is connected to said processor means (20) and contains a set of data (22*a*) associated with each key (10-10), each set of data including a predetermined sequence of pitch values. Each time a key (10–19) is struck the processor means (20) reads an item of data in sequence from the data set (22*a*) and generates an output signal that includes a consecutive one of said pitch values.

17 Claims, 8 Drawing Sheets

81 84 84a 85 85a 86 86a 83

| Bar # | 1 | 2 | 3 | 4 | 5 | 6 |
|---|---|---|---|---|---|---|
| Key Counter 9 | 1 | 1 | 1 | 2 | 4 | 4 |
| Key Counter 8 | 1 | 1 | 1 | 1 | 3 | 3 |
| Key Counter 7 | 1 | 1 | 1 | 1 | 5 | 6 |
| Key Counter 6 | 1 | 1 | 1 | 1 | 3 | 4 |
| Key Counter 5 | 1 | 1 | 1 | 2 | 4 | 5 |
| Key Counter 4 | 1 | 2 | 4 | 5 | 7 | 7 |
| Key Counter 3 | 1 | 2 | 4 | 5 | 7 | 7 |
| Key Counter 2 | 1 | 1 | 1 | 1 | 1 | 3 |
| Key Counter 1 | 1 | 1 | 3 | 4 | 6 | 8 |
| Key Counter 0 | 1 | 1 | 3 | 4 | 6 | 6 |

82

Bar # Counter Array

Fig. 4b

91

| Section # | 1 |
|---|---|
| Key Counter 9 | 1 |
| Key Counter 8 | 1 |
| Key Counter 7 | 1 |
| Key Counter 6 | 1 |
| Key Counter 5 | 1 |
| Key Counter 4 | 1 |
| Key Counter 3 | 1 |
| Key Counter 2 | 1 |
| Key Counter 1 | 1 |
| Key Counter 0 | 1 |

Section # Counter Array

Fig. 4c max = 5 trv = 0 (at start)

Fig. 4e

101 102 103 104

| Note # | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|
| Key Ctr. | 3 | 4 | 0 | 1 | 3 | 4 | 0 | 1 | 3 | 4 | 0 | 1 | 3 | 4 | 5 | 9 | 0 | 1 | 6 |
| Array | 1 | 1 | 1 | 1 | 2 | 2 | 2 | 2 | 3 | 3 | 3 | 3 | 4 | 4 | 1 | 1 | 4 | 4 | 1 |

| Note # | 20 | 21 | 22 | 23 | 24 | 25 | 26 | 27 | 28 | 29 | 30 | 31 | 32 | 33 | 34 | 35 | 36 | 37 | 38 |
|---|---|---|---|---|---|---|---|---|---|---|---|---|---|---|---|---|---|---|---|
| Key Ctr. | 7 | 5 | 9 | 3 | 4 | 8 | 7 | 0 | 1 | 5 | 6 | 7 | 9 | 3 | 4 | 8 | 7 | 1 | 2 |
| Array | 1 | 2 | 2 | 5 | 5 | 1 | 2 | 5 | 5 | 3 | 2 | 3 | 3 | 6 | 6 | 2 | 4 | 6 | 1 |

105

| Note # | 39 | 40 | 41 | 42 | 43 | 44 | 45 | 46 | 47 | 48 | 49 | 50 | 51 | 52 | 53 | 54 | 55 | 56 | 57 |
|---|---|---|---|---|---|---|---|---|---|---|---|---|---|---|---|---|---|---|---|
| Key Ctr. | 6 | 1 | 2 | 5 | 7 | 1 | 2 | 3 | 6 | 7 | 5 | 1 | 2 | 3 | 6 | 7 | 0 | 4 | 5 |
| Array | 3 | 7 | 2 | 4 | 5 | 8 | 3 | 7 | 4 | 6 | 5 | 9 | 4 | 8 | 5 | 7 | 6 | 7 | 6 |

Note # Counter Array 106 107

Fig. 4d

MUSICAL INSTRUMENT

The present invention relates to a musical instrument. In particular, but not exclusively, the invention relates to a keyboard instrument.

For most musical instruments the need for a player to move his or her fingers to create the appropriate settings by which the required musical pitches are produced or are enabled to be produced is an accomplishment which usually requires considerable effort to master. Even then it is only a small proportion of instrumentalists who achieve anything like the proficiency they would like to. For most amateur instrumentalists especially there is likely to be a range of repertoire, consisting partly of some of the most musically satisfying pieces which they would like to play, which lies beyond their capability.

While the utility of the present invention is applicable to substantially all musical instruments in which pitch is controlled by various positionings of the player's fingers, the invention's most likely wide ranging application is in its use to transform a traditional keyboard instrument, such as the piano. It is an embodiment of a form of this use of the invention which will be presented here. Its similar applicability to other relevant musical instruments, which will be commented on occasionally, will be apparent.

In a traditional keyboard instrument such as the piano each key produces a note of just one pitch. A typical piano having a range of a little over 7 octaves therefore generally has a total of almost 90 keys, and thus of almost ninety different pitches. To play the piano, the pianist has to strike the correct keys at the right time, essentially without looking at the keyboard. The difficulties of doing this are obvious and are made more difficult by the fact that the fingerings required may be very difficult to accomplish, even for the most dextrous players.

Some attempts have been made to make playing a keyboard instrument simpler. For example, U.S. Pat. No. 5,425,297 describes an electronic keyboard instrument in which the keyboard is in two parts. The right-hand part is in the form of a conventional keyboard and is played using the fingers of the right hand to generate a melody. The left-hand part comprises a set of five keys that are struck in different combinations using the fingers of the left hand to generate a series of simple chords to accompany the melody.

Although this instrument simplifies the playing of certain types of popular music (in particular, those in which the left hand is only required to play chords), it is not suitable for playing forms of music such as much classical music that are not so simply constituted and which may contain quite complicated polyphony. While the task of the right hand in playing this instrument is simpler than in a conventional keyboard instrument in that the particular notes assigned to the five right hand keys could be notes that the player would otherwise have to move his or her hand to reach, this utility is quite limited in that those keys continue to play the same five notes until ancillary keys are struck to change some or all of them.

According to the present invention there is provided a musical instrument comprising a plurality of keys, a processor means connected to said keys and arranged to receive signals therefrom and having an output arranged to provide an output signal to be utilised in the generation of notes, and a data storage means connected to said processor means, said data storage means containing a set of data associated with each key, each set of data including a predetermined sequence of pitch values, the arrangement being such that when a key is struck the processor means reads an item of data from the data set associated with that key and generates an output signal representing the pitch value associated with that item of data, whereby repeatedly striking a key causes an output signal to be generated that includes the predetermined sequence of pitch values associated with that key.

The instrument may be arranged such that when a key is released an output signal is generated indicating that the note generated by striking the key has been terminated.

The output may be connected to a sound generating means, for example an electronic synthesizer. Alternatively, the output may be connected to a means for controlling the pitch setting of a traditional musical instrument, such as a woodwind, brass or string instrument.

The loudness of the note to be generated may depend on the velocity of the key that has been struck.

Because the pitch values are assigned to the keys by the processor means (hereafter referred to as a computer), and each key can cause a different pitch to be produced or to be enabled to be produced each time it is struck, it is possible, by arranging the sequence of pitch values included in the set of data associated with each key, to make it possible to play all the notes of a given musical work using a keyboard consisting of a minimum number of keys. In the case of an instrument which can produce only one note at a time a keyboard consisting of one key would be sufficient, though two keys would probably be preferable. In the case of an instrument which is able to produce four notes at a time, such as a cello, a keyboard consisting of four keys would be necessary. And so on. For a traditional keyboard instrument such as a piano a keyboard consisting of ten keys, as is detailed below, is suitable. The advantage to a player playing music utilising such a keyboard in place of a traditional keyboard in not having to move his or her fingers from one key to another and thus never having to ever look down at the keyboard to make sure that his or her hand and thus finger or fingers is put in the right place is obvious. Further, the notes of a composition can be assigned to the keys in such a way that makes fingering of them as convenient as possible: such as by setting a trill, for instance, to be played using those fingers with which a player is most adept at playing trills. But this is not the only advantage such a keyboard would confer. In terms of expense of manufacture, and thus of cost to the consumer, as well as of the amount of space required to house it, the utility of an instrument which consists of only ten keys in comparison to an instrument which otherwise must consist of somewhere around nine times that number of keys, is obvious. A further advantage of the invention is that it will allow composers to write music for a keyboard instrument consisting of chords or progressions of notes which, because of the limitation of the human hand, it would not be possible to play on a traditional keyboard. A further advantage of the invention is that the program could be modified so as to allow more than one pitch to be output as the result of a particular keystroke. Such a utility, as well as being of obvious advantage to composers, could be utilised to enable a player having less than ten fingers to play, though obviously less effectively, musical works which would otherwise require the use of all ten fingers. A further advantage of the invention is that it could be modified to allow a player to alter the pitch values by a specific amount. This would enable a player to alter the key of a musical work without having to change the fingering required to play it, thus enabling him or her to easily accommodate the range of an accompanied singer or to play in a key suitable to an accompanying instrument. To execute such transposition on a traditional keyboard instrument is difficult.

In playing a musical work the basic function of the invention is substantially as follows: the pitch value of the first note of the musical work will be first pitch value assigned to a particular data sequence for a particular key. By striking that key the player will cause to be produced, or enable to be produced, the first note of the work. The pitch value of the second note of the work may be the second pitch value assigned to the same key to which the pitch value of the first note was assigned, in which case the player will strike the same key twice so as to cause to be produced, or enable to be produced, the first two notes of the work. Or the pitch value of the second note of the work may be the first pitch value assigned to a particular data sequence for a key other than the key to which the pitch value of the first note of the work is assigned, in which case the player will strike one key to produce the first note of the work and then strike another key in order to produce the second note of the work, and so on, with the pitch value of each of the notes of the musical work allocated to a particular data sequences of one of the keys, in such a manner as to enable the musical work to be played. For an instrument which plays more than one note at a time a score specifically designed to serve such a purpose, as is detailed below, would be suitable.

In an application of the invention to a traditional keyboard instrument such as a piano, the output may be connected to an electronic sound generating means, for example an electronic synthesizer. Or the output may be connected to a means which activates the action of a traditional keyboard instrument, such as the action of a piano. Alternatively, the output may, in an application of the invention to an instrument other than a keyboard instrument, be connected to a means for controlling the pitch setting of the instrument, thus enabling the player to concentrate more fully on producing the desired sound, since it would not be necessary for him or her to do more than depress a key in order for the instrument to be altered in such a manner as to enable it to produce the requisite pitch.

The instrument may include means for designating a key strike as a trill note: this may, for example, comprise a particular data value that the computer recognises as designating a trill note, This allows the computer to distinguish between notes that are repeatedly struck an indeterminate number of times (referred to hereafter as "trill" notes) and other notes that are only struck once, after which the computer moves on to the next note.

The instrument may include means for designating a key strike as a trill release note. This allows the computer to recognise when a trill note has ended, implying that further strikes to the key or keys that played the trill are to be treated normally, i.e. that the computer is to retrieve the relevant subsequent pitch values from the data storage means.

The instrument may include means for indicating that a particular key strike does not represent an audible note. This may be useful when, for example, it is necessary to indicate that a trill note has ended without generating another audible note, or when no further notes are assigned to that particular key.

The processor means may be arranged to receive signals from other input devices, for example pedals.

The data set associated with each key may include data work. This is useful for indexing and search purposes.

The instrument may include means for selecting one of a plurality of musical works to be played.

The instrument may include means for moving forwards and backwards through the musical work.

The instrument may include means for displaying the score of a musical work. The display means may be arranged to advance automatically as the player progresses through the work, so avoiding the need for the player to turn the pages of a printed score or advance the score manually in any other way. Advantageously, the display means includes first and second display areas and is arranged to display consecutive segments of the musical score alternately in said first and second areas as the player progresses through the work. The display means preferably includes means for highlighting the next notes to be played.

The keys may be arranged in two groups of five keys each.

The two groups of keys may be angled relative to one another.

An embodiment of the invention will now be described, by way of example, with reference to the accompanying drawings, of which:

Figure 4A:
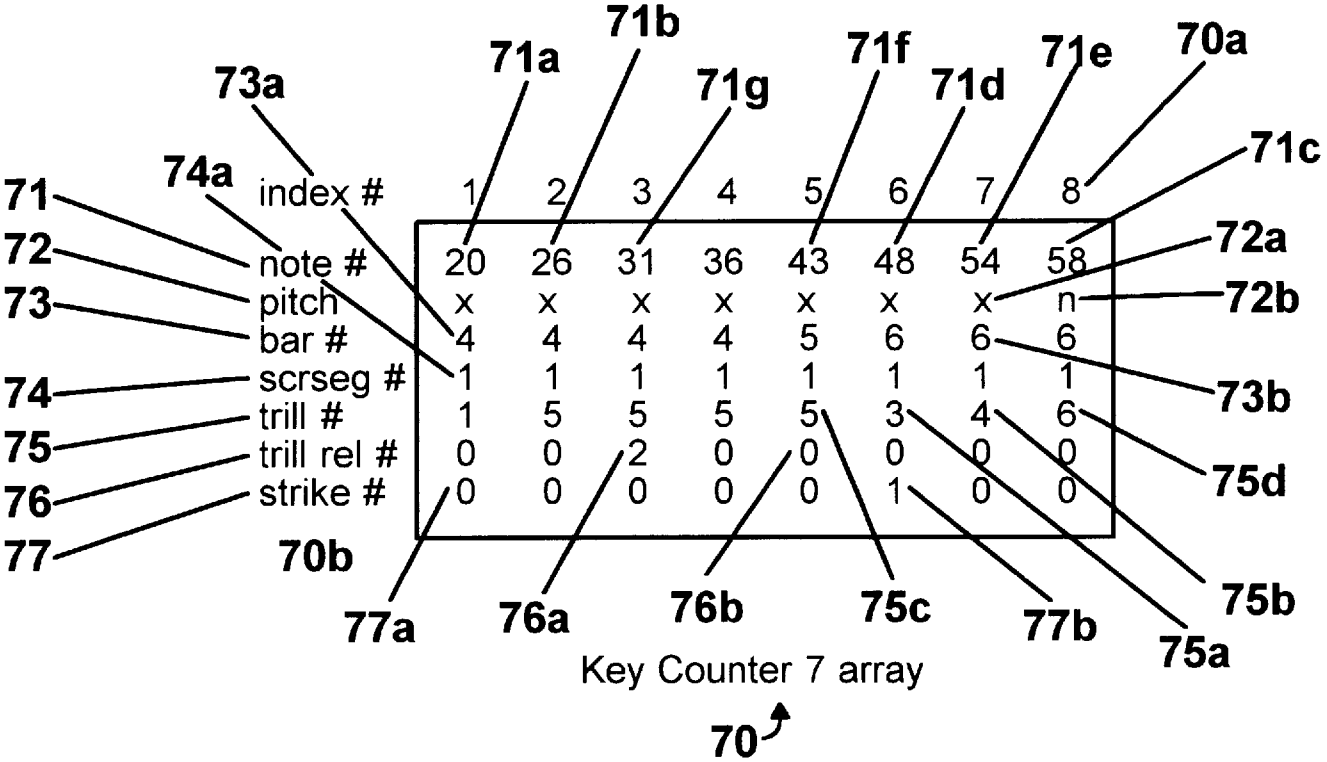

FIG. 4*a* is an example of a data array associated with one key of the keyboard;

FIG. 4*b* is an example of a bar number counter array;

FIG. 4*c* is an example of a section number counter array;

FIG. 4*d* is an example of a note number counter array,

FIG. 4*e* represents the contents of two further data stores, and

Figure 5:
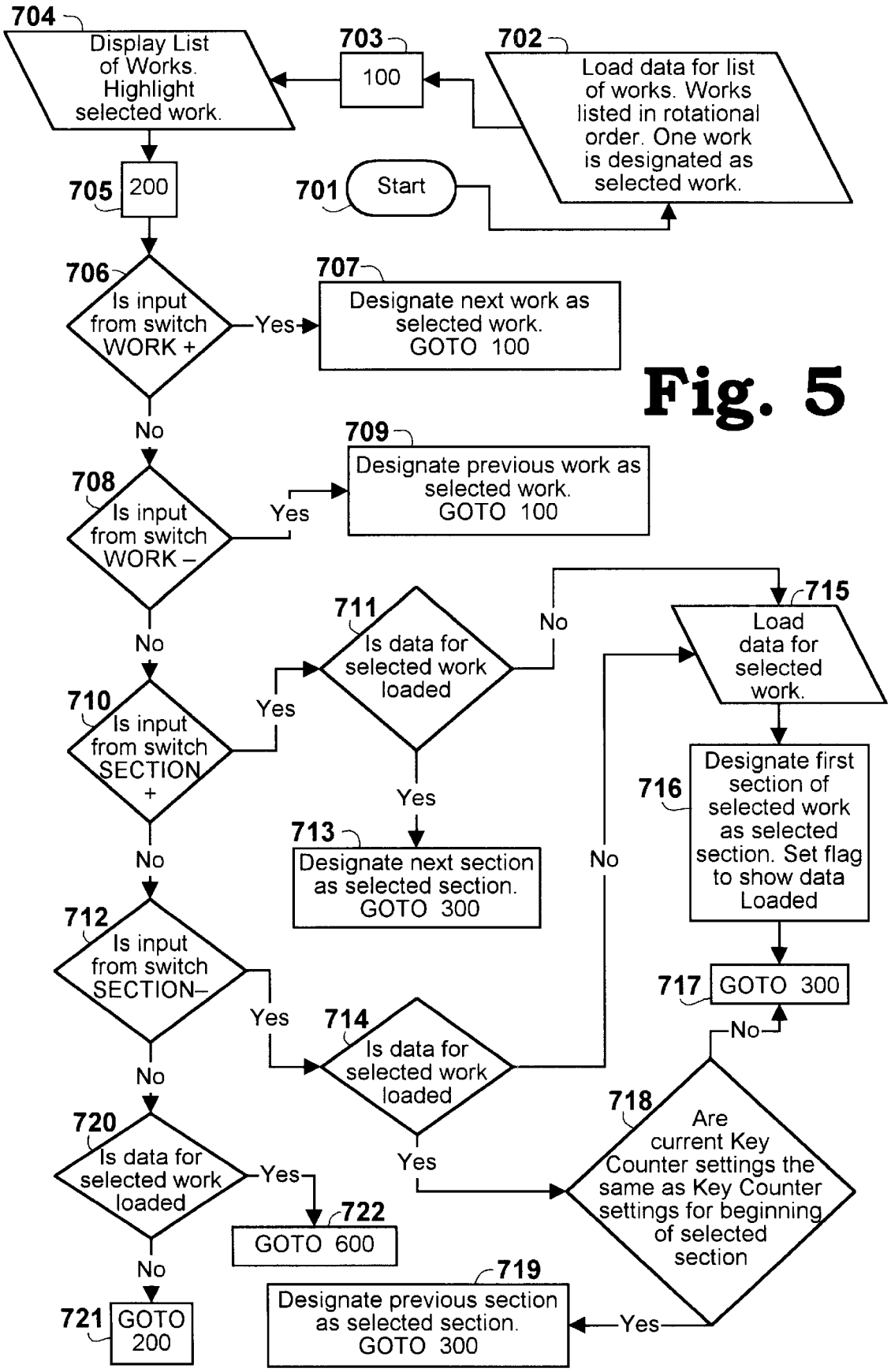
Figure 6:
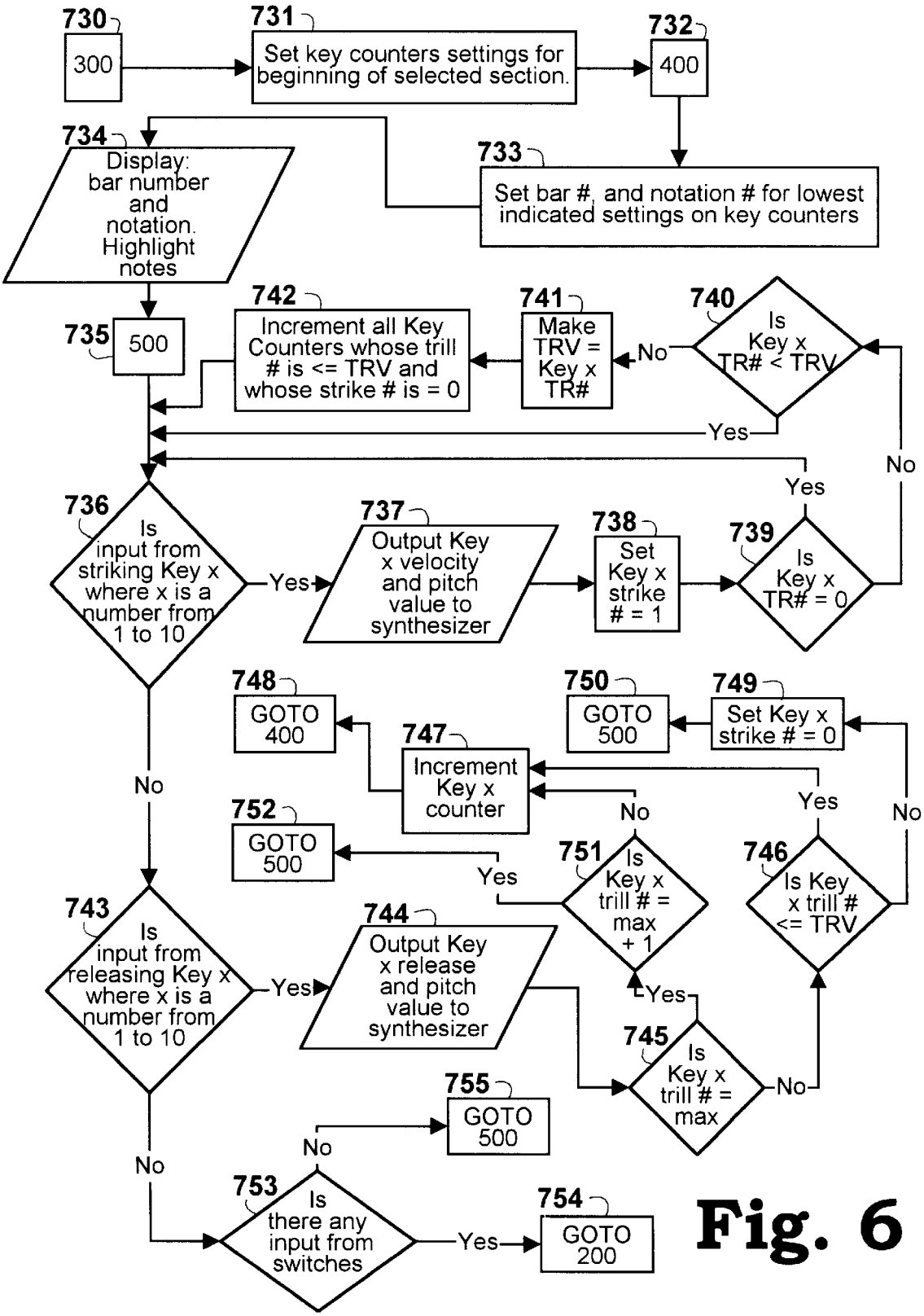
Figure 7:
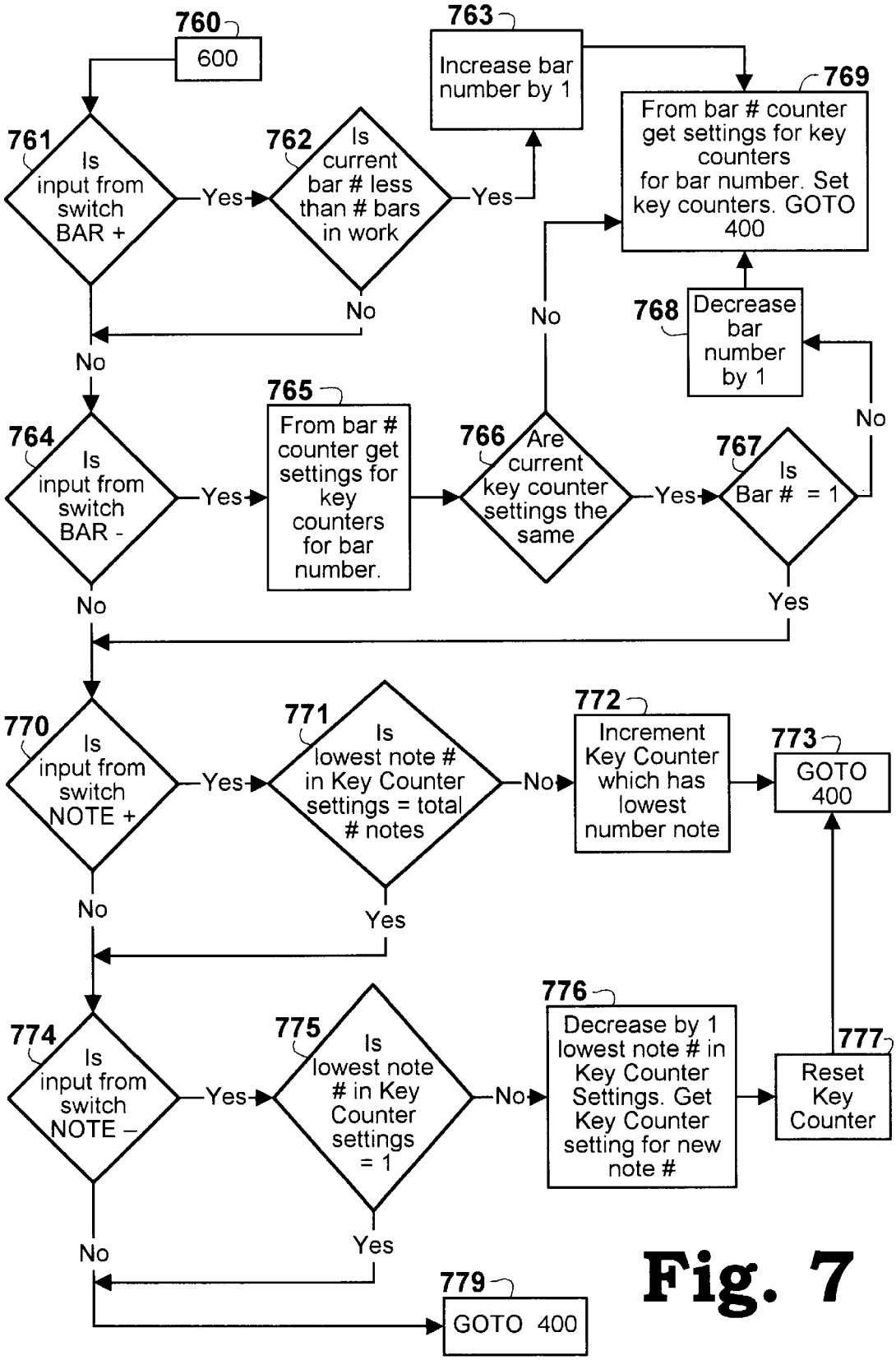

FIGS. 5, 6 and 7 are flowcharts that outline the main steps of a computer program associated with the invention.

Figure 1:
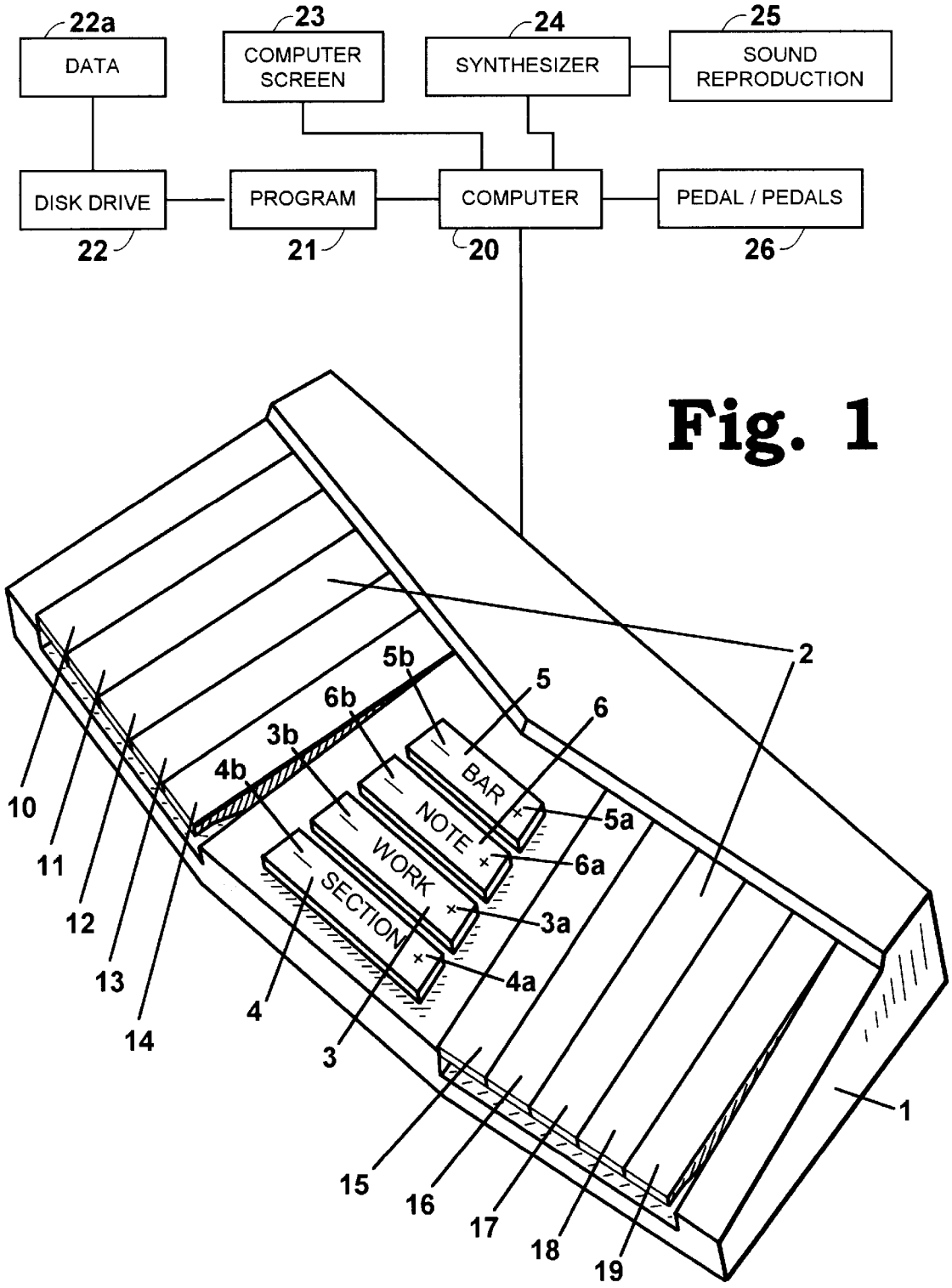
FIG. 1 shows a keyboard that is connected to an external computer and various other peripheral devices, all of which are represented schematically.

In the embodiment shown in FIG. 1, the musical instrument includes a keyboard 1 having ten keys arranged in two sets 2 five keys each. The two sets of keys are angled outwards slightly for ergonomic efficiency. Located between the two sets of keys 2 there are provided four non-latching double-ended rocker arms 3,4,5,6. These keys consist of a WORK+ switch 3*a* and a WORK− switch 3*b,* which are activated by pressing on the right- and left-hand sides respectively of rocker arm 3; a SECTION+ switch 4*a* and a SECTION− switch 4*b,* which are activated by pressing on the right- and left-hand sides respectively of a rocker arm 4; a BAR+ switch 5*a* and a BAR− switch 5*b,* which are activated by pressing on the right- and left-hand sides respectively of a rocker arm 5, and a NOTE+ switch 6*a* and a NOTE− switch 6*b,* which are activated by pressing on the right- and left-hand sides respectively of rocker arm 6. These rocker arms 3,4,5,6 are used for selecting the work of music to be played and moving backwards and forwards through the work to the desired location, as is described in more detail below.

The two sets 2 of keys are designed to be played using the left and right hands. The left-hand set 2 consists of five keys 10–14 that are played using the five digits of the left hand and a right-hand set 2 consists of five keys 15–19 that are played using the five digits of the right hand. In use, the player places his or her hands above the keyboard 1, with one digit above each of the keys, and does not subsequently move his or her hands from those locations. It is not therefore necessary for the player to look down at the keyboard or to learn the positions of the keys.

The keyboard 1 is electronically connected to a computer 20 and is arranged to send to the computer 20 appropriate strike and impact (i.e. velocity) information each time one of the keys 10–19 is struck, and release information when the key is released. Appropriate information is also transmitted to the computer each time one of the rocker arms 3–6 is pressed.

The computer 20 is programmed to operate in accordance with the signals transmitted to it from the keyboard 1, the instructions contained in a program 21 and the data 22*a* stored in a storage means 22, which may for example be a disk drive. The computer is also connected and arranged to send output signals to a display means 23, for example a computer screen, and a sound generating means, for example a synthesizer 24 and a loudspeaker 25. The computer 20 may also be connected to receive input signals from a pedal or pedals 26, for example a sustain pedal.

Figure 2:
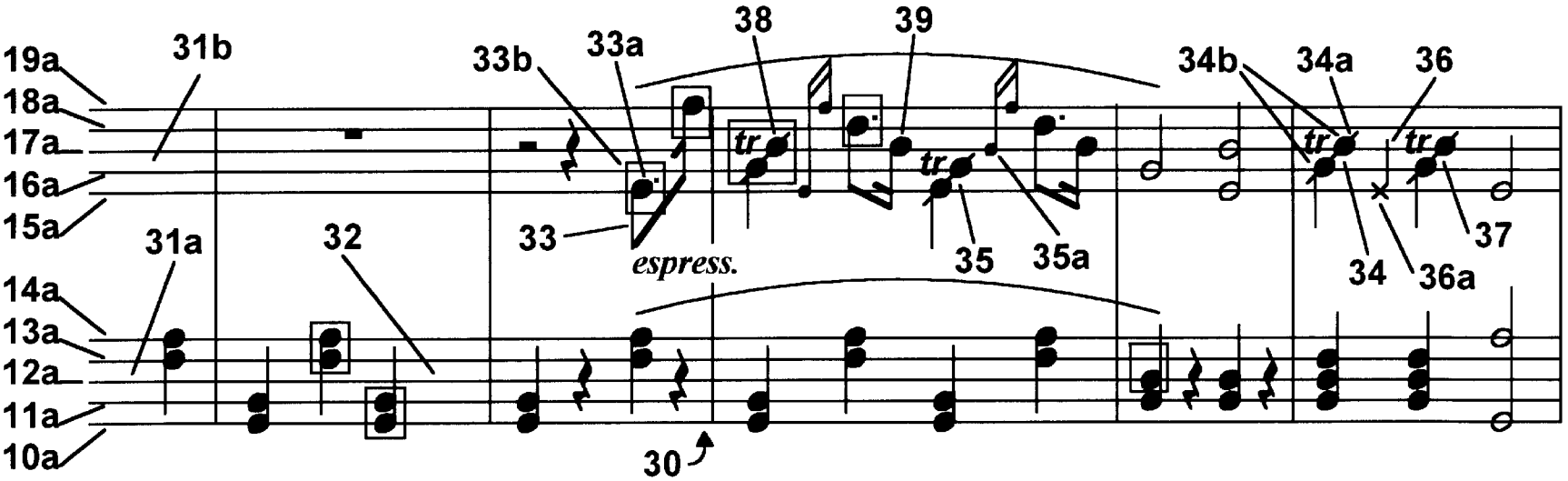
FIG. 2 shows a section of a musical score written using a special form of notation designed for use with the invention.

An example of a musical score written using a special form of notation designed particularly for use with the present invention is shown in FIG. 2. Although the score resembles a conventional musical score it is, in fact, fundamentally different, as will become apparent. The score consists of ten horizontal lines 10*a*–19*a* arranged in two sets 31*a*, 31*b* of five lines. Each of these lines represents one key of the keyboard 1, line 10*a* representing key 10, line 11*a* representing key 11, and so forth. A note placed on one of these lines is played by pressing the corresponding key. Thus, for example, the two notes comprising the chord 32 are played by pressing keys 13 and 14 simultaneously. However, unlike a conventional score, the lines do not represent the pitch of the notes as pitch values are ascribed to the notes by the computer. The duration of the notes is indicated in a conventional manner.

Those notes that are next to be played by striking a particular key 2 are highlighted. A highlighted note 33 is indicated in FIG. 2 by means of a rectangle 33*b* drawn around the highlighted note's head 33*a*. On the computer screen 23 such highlighting would be indicated for example by changing the colour or brightness of the highlighted note. The computer program 21 highlights the next note on each line 10*a*–19*a* that is to be played. This enables the player to see easily which keys 2 are next to be struck when playing a musical work.

The score includes a number of other unconventional features. For example, a trill is indicated by means of a line 34*a* drawn through the two notes 34*b* of the trill 34. Every trill 35 is followed by a trill release note 35*a*, the purpose of which is described below. If the trill release note has no pitch value, its head is replaced by a cross 36*a*.

Figure 3:
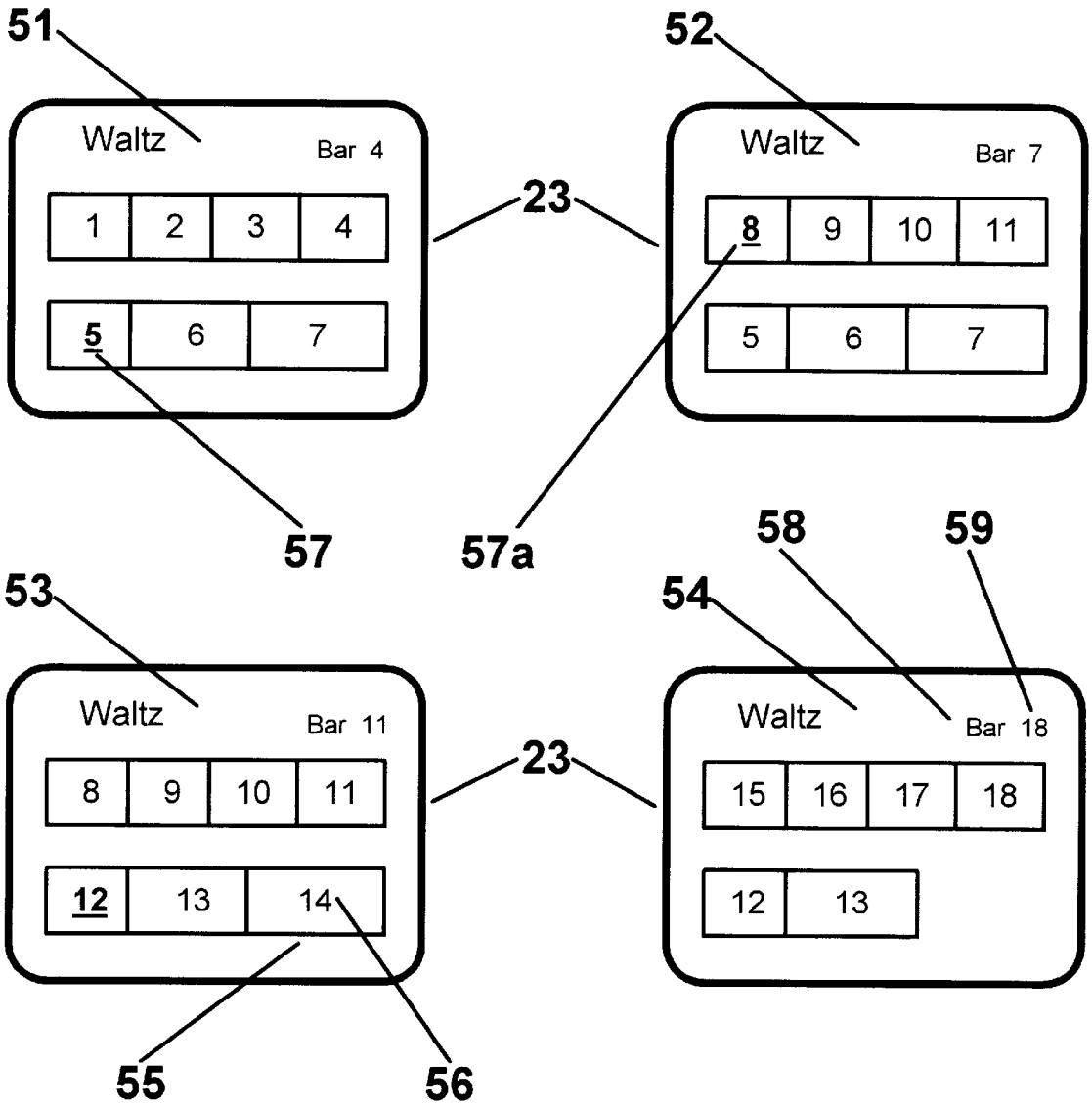
FIG. 3 shows how the musical score may be displayed on a computer screen.

FIG. 3 shows how the musical score may be displayed on the computer screen 23. At the start of the work, the screen displays an image 51 comprising two horizontal lines, each consisting of a number of bars of the score. For example, the upper line may depict bars 1 to 4 and the lower line may depict bars 5 to 7. As the work is played the computer 20 keeps track of the position in the score and as soon as the first bar 57 of the lower line is reached, the upper line is replaced by the next passage of the score, for example bars 8 to 11, to produce a second image 52. In the example, a third image 53 will be generated when bar 8 57*a* is reached and a fourth image 54 upon reaching bar 12. The word "Bar" 58 and the number of the bar being played 59 are displayed in one corner of the screen.

The data 22*a* is stored in the storage means 22 in the form of a number of arrays. These include a set of ten key counter arrays 70, each of which is associated with a different one of the keys 10–19. One of those key counter arrays 70 (the seventh array, which is associated with the seventh key 17) is shown in FIG. 4*a*. The array includes a set of data values representing various attributes of each note played by striking that key. These attributes comprise the note number 71, the pitch 72 (i.e. the pitch value), the bar number 73, the score segment number 74, the trill number 75, the trill release number 76 and the strike number 77. In this example, the pitch value is represented simply as "x" for each of the notes in the score. In reality, of course, The "x" would be replaced by a data value that indicates to the computer the pitch of the note to be generated. The function of each of the data values is explained in more detail below.

Various other arrays and variables are shown in FIGS. 4*b*, 4*c*, 4*d* and 4*e*. These include a bar number counter array (FIG. 4*b*), a section number counter array (FIG. 4*c*), a note number counter array (FIG. 4*d*) and variables "max" and "trv" (FIG. 4*e*). The function of each of these arrays and variables is also explained in more detail below.

When the computer program 21 starts it accesses a list (not shown) of the works available on the memory storage means 22 and displays this list on the screen 23. One of the works on the list will be highlighted. Pressing either the WORK+ switch 3 or the WORK– switch 3*a* allows a player to change the work which is highlighted, going either backwards or forwards through the list which is in rotational order, i.e. the first work is preceded by the last work and the last work is proceeded by the first work.

To select the highlighted work to be played the player presses either the SECTION+ switch 4*a* or the SECTION– switch 4*b* whereupon the opening bar or bars of the musical work appear on the screen in the form of notation 30 shown in FIG. 2.

Once a work has been selected to be played pressing the WORK+ switch 3*a* or WORK– switch 3*b* allows the player to bring the list of works again to the screen and chose a new work be highlighted.

During a performance on the instrument, whenever one of the keys is struck, a signal that indicates which of the keys has been struck (for example key 17) and the velocity of the key strike is sent from the keyboard 1 to the computer 20. Upon receipt of that signal, the computer 20 examines the data array 70 associated with that key and then reads the data values associated with that key strike.

For example, in the array shown in FIG. 4*a*, the first time the seventh key 17 is struck the computer 20 will read the data values shown under index #1, the second time the seventh key 17 is struck the computer 20 will read the data values shown under index #2, and so forth. Thus, the computer 20 will read that the first strike (index #1) represents the 20th note of the musical work, has a pitch value x, is found in the fourth bar of the work in score segment 1, and is one note of the first trill. Similarly, the second strike (index #2) represents the 26th note of the musical work, has a pitch value x, is found in the fourth bar of the work in score segment 1 and is not a trill note (this being indicated in the particular work illustrated by the data value 5).

After reading the data values associated with the key strike, the computer 20 sends a signal to the sound generating means 24 that causes the sound generating means to generate a note of the appropriate pitch and loudness, as determined by the pitch value 72 read from the data store 22 and the key velocity information transmitted to the computer from the keyboard 1. The signal transmitted to the sound generating means may be modified according to any signals received from a pedal or pedals 26 connected to the computer 20. When the key 17 is released, a release signal is sent from the keyboard 1 to the computer 20, which in turn causes the sound generating means to cease generation of that note (unless a sustain signal is received, as from a sustain pedal 26).

This process is repeated every time one of the keys 10–19 is struck, in each case the data values for each note being read from the appropriate key counter arrays. In this way the entire musical work is generated.

It will be noted that every time a key is struck, the pitch of the note generated by the sound generating means is determined solely by the pitch value stored in the data storage means 22. These pitch values may be different each time the key is struck and a whole series of notes may thus be played by repeatedly striking the same key. In an extreme case, a simple one line melody may be played simply by repeatedly striking a single key with one finger. Although in most cases, especially where the melody is harmonised, it will be necessary to strike more than one key simultaneously, it is never necessary to move the fingers from one key to another and this obviously makes playing the instrument very much easier than playing a conventional keyboard instrument.

The duration of each note and the relative loudness of the notes remain under the player's control. The player is thus able to effect crescendos and decrescendos, to accent particular notes and to vary the speed and rhythm of the work so as to express him or herself musically. A musically satisfying performance may thus be produced, but without some of the technical difficulties associated with a conventional keyboard instrument.

Normally, as described above, every time a key is struck the computer 20 will read the next set of data values associated with that key. However, there are certain special circumstances when a note may be repeatedly struck an indeterminate number of times, for example when playing a trill or an ostinato note. Such notes, which will be referred to hereafter as "trill" notes are treated in a special way, as follows. Whenever the musical work calls for a trill note, this is labelled as such in the data array associated with the key or keys used to play that trill note. When the computer comes across a note labelled as a trill note it does not move any further through the array until a second key designated as a trill release key is pressed. The key or keys used for playing trill notes may thus be struck an indefinite number of times without the computer advancing further through the array. However, as soon as the trill release key is struck, the computer resumes normal operation and each subsequent key strike thus causes the computer to advance through the array in the usual note-by-note manner.

An example of a trill note is illustrated in FIGS. 2 and 4*a*. The trill 34 in FIG. 2 is played by striking keys 16 and 17 alternately. The number of times these keys will be struck is unpredictable and indefinite and these notes are therefore labelled as trill notes in the arrays associated with those keys. For example, one of the notes of trill 34 corresponds to index #6 in the array associated with key 17, and this note, as it occurs in the third trill in the score 30, has trill #3 associated with it and causes the computer to advance no further through the array until the appropriate trill release key is struck.

An example of a trill release note is illustrated at 76*a* in FIG. 4*a*. The trill release #2 indicates that when this note (the grace note 35*a* in FIG. 2) is struck it releases the notes of the second trill 35. An example of a special form of trill release note is illustrated by note 36 in FIG. 2, which is played by striking key 15. The "X" 36*a* that replaces the normal head of this note indicates to the player that the note has no pitch value associated with it and so will be inaudible, its sole function being to release the notes of trill 34.

The data arrays and the functions of the data values contained therein will now be described in more detail. FIGS. 4*a* and 4*b* show illustrative samples of basic arrays and variables which the program 21 obtains from the data 22*a*. Specific values given in FIGS. 4*a* and 4*b* relate to the notation 30 shown in FIG. 2. The pitch values for the notes of the work are held in the data 22*a* in ten Key Counter arrays (only one of which, the array for the seventh key 17, is shown).

Each Key Counter array 70 contains the pitch values for the notes 32 which are placed on a particular one of the ten lines 10*a*–19*a* of the musical score 30. The notes assigned to the seventh Key Counter array are the notes that are placed on line 17*a* of the notation 30, the notes assigned to sixth Key Counter array are those placed on line 16*a* of the notation 30, and so on. The ten Key Counter arrays 70, are each dimensioned x+1 to 7, where x is the number of notes assigned to the Key Counter. It can be seen that the seventh Key Counter 70 has seven notes assigned to it as its final primary dimension index number 70*a* is 8. The array, of the seven secondary dimensions 70*b* of the seventh Key Counter array 70 (as well as the array of the secondary dimension of each of the other nine Key Counter arrays) holds values for:

1. a Note # 71. The number of a first note 71*a* assigned to the seventh Key Counter array 70 is a twentieth note 38 of the notation 30. The number of a second note 71*b* assigned to the seventh Key Counter array 70 is a twenty-sixth note 39 of the notation 30, and so on. The number of a last note 71*c*, assigned to the seventh Key Counter array 70 (as well as being the number assigned to the last note of each of the other nine Key Counter arrays) is not the number of an actual note of the notation 30 but is assigned the value of the total number of notes in the notation 30 (in the notation 30 there are fifty-seven notes) +1.
2. a Pitch Value 72. The pitch value is given in a form that is responded to by the synthesizer 24. No specific pitch values are shown as being assigned to the Key Counter array 70. For convenience each pitch value has been assigned a value "x" 72*a*. Where a pitch is not intended to be sounded the pitch value is given in a form that is not responded to by the synthesizer 24. In the Key Counter array 70 a value of "n" 72*b* is used to signify a pitch value that is not responded to by the synthesizer 24.
3. a Bar # 73. It can be seen that the twentieth note 71*a* is in the fourth bar 73*a* of the notation 30, the fiftieth-fourth note 71*e* of the notation 30 is in the sixth bar 73*b* of the notation 30, and so on.
4. a Score Segment # 74. It can be seen that all the notes assigned to the seventh Key Counter array 70 are in the first section 74*a* of the notation 30.
5. a Trill # 75. A trill # value 3 75*a* indicates that the forty-eighth note 71*d* of the notation 30 is a note of the third trill 34 of the notation 30. A trill # value 4 75*b* indicates that the fifty-fourth note 71*e* of the notation 30 is a note of the fourth trill 37 of the notation 30, and so on. A. trill # value 5 75*c* is the value of the variable 'max' (FIG. 4*e*) which is the value of the total number of trills in a work plus one (in the notation 30 there are four trills). (Note: a trill is any note or note configuration, such as an ostinato, which is played an indeterminate number of times). The trill # value of 5 75*c*, (the value of the variable 'max') indicates to the program 21 that note forty-three 71*f* is not a trill note. A trill # value 6 75*d*, which is the value of 'max' +1, indicates to the program 21 that the Key Counter array should not be incremented when the key 17 that plays note #58 71*c* is released. The value 'max' and the value 'max' +1 has the same function in relation to the note # which appears in the same secondary dimension as itself in all of the other nine Key Counter arrays (not shown).

6. a Trill Release # 76. A Trill Release # value of 0 76*b* indicates to the program 21 that note forty-three 71*f* is not a trill release note. A Trill Release # value of 2 76*a* indicates to the program 21 that a note 31 71*g* is a trill release note for the second trill 35 of the notation 30, and so on.
7. a Strike # 77. A strike # value of 0 77*a* is the initial setting for all strike #s A strike # 1 77*b* indicates to the program 21 that the particular key 17 which plays note 48 71*d* has been struck but has not been released. The strike #s 0 77*a* and 1 77*b* are used by the computer program 21 to determine whether a key that has been struck as a trill note has or has not been released so that the computer program does not, upon the striking of the key which plays the trill notes' trill release note, increment the Key Counter of the trill note until the key has been released.

The Bar # Counter array (FIG. 4*b*) is dimensioned 1:10. Each index number 81 of the primary dimension of the Bar # array is equivalent to the number of a particular bar of the work. Ten secondary dimensions 82 hold the Key Counter array settings for the beginning of each bar. For example: in the ninth Key Counter, a secondary dimension 83 is assigned to the notes that are placed on line 19*a* of the musical notation 30. If the program 21 were to set the musical notation 30 to start at the first, second, or third bars 84 it would set the ninth Key Counter array primary dimension setting to 1 84*a*. If the program 21 were to start the musical notation 30 at the fourth bar 85 it would set the Key Counter array primary dimension setting to 2 85*a*. If the program 21 were to start the musical notation 30 at the fifth or sixth bars 86 of the musical notation 30 it would set the Key Counter array primary dimension setting to 4 86*a*.

The Section # Counter array (FIG. 4*c*) is dimensioned 1:10. Each index number of the primary dimension of the Section # Counter array is equivalent to the number of a particular section of the work. The ten secondary dimensions hold the Key Counter array settings for the beginning of each Section. It will be seen that the notation 30 has only one section and that there is therefore only one primary index number 91.

The Note # Counter array (FIG. 4*d*) is dimensioned 1:2. Each index number 101 of the primary dimension of the Note # array is equivalent to the number of a particular note of the work. The two secondary dimensions hold the Key Counter array setting for each note. For instance, a note # 15 102 (which is note 33*a*) is set using the fifth 103 Key Counter array at its 1st 104 index setting. Note # 49 105 (which is note 36) is set using the fifth 106 Key Counter array at its fifth 107 index setting, and so on.

A set of flowcharts that illustrate operation of the computer program 21 are shown in FIGS. 5 to 7.

After starting the program at step 701, the list of works held in the memory storage means 22 is accessed and loaded at step 702. One of the works in the loaded list will be designated as the selected work. This selected work might be the major work on the list or the first work of a set of works on the list. At step 704 the list of works is displayed and the selected work is highlighted.

If either the WORK+ switch 3*a* or the WORK− switch 3*b* is activated then steps 706 and 707 or steps 708 and 709 designate either the next higher or the next lower work in the list as the selected work, sending the program back to program line 100 (step 703) and causing the list of works to be displayed by step 704 with the new selected work highlighted. The list of works is rotational so that the last work is proceeded by the first work and the first work is preceded by the last work.

Steps 710–719 constitute the section of the program that carries out the functions of the SECTION+ switch 4*a* and the SECTION− switch 4*b*.

If the data for the selected work has not been loaded then the activation of either the SECTION+ switch 4*a* through steps 710, 711 and 715 or the SECTION− switch 4*b* through steps 712, 714 and 715 loads the data 22*a* for the selected work. In either case, step 716 designates the first section of the selected work as the selected section and sets a flag to show that the data for the selected work has been loaded.

If the selected work has been loaded then activation of the SECTION+ switch 4*a* designates (by way of steps 710, 711, and 713) the section of the work following the section already selected to be the selected section.

If the selected work has been loaded then activation of the SECTION− switch 4*b* sends the program through step 712 and step 714 to step 718. Step 718 determines whether or not any notes have already been played in the selected section before deciding whether (if no notes have been played in the selected section) to designate the section proceeding the already selected section as the selected section (step 719) or, if a note or notes have been played in the already selected section, to designate the already selected section as the section, thus allowing a player who is in the middle of a section to return to beginning of the same section. The list of sections is rotational so that the last section is proceeded by the first section and the first section is preceded by the last section.

In whatever above manner a section is selected, either step 717 or step 719 sends the program to program line 300 step 730, following which, at step 731, values of the Key Counter sets for the beginning of the selected section are accessed through reference to the Section Counter. Step 733 determines which is the lowest bar # and the lowest score segment # of the values of the Key Counters sets. Step 734, using the lowest bar # and the lowest score segment # obtained at Step 733, causes the Bar # 59 and the score segment 51–54 referred to by the score segment # to be displayed on the screen 23. Also caused to be displayed on the screen 23 at step 733 are those notes in their highlighted forms the values of which appear in the Key Counter sets and which also appear in the displayed score segment 51–54.

At step 736 key strike information from the keys 2 is accessed. If there has been a key strike, step 737 gets the pitch value of the note from the struck keys' Key Counter set and outputs the velocity of the key stroke and the pitch value of the note to the synthesizer. At step 738 the value of the Strike # of the note's Key Counter set is set to 1. At step 739 the computer program determines from the note's key counter set if the note's trill release value is 0 (i.e. the note is not a trill note) If YES the computer program goes back to step 736. If NO the computer program determines at step 740 if the value of the Trill Release # of the note's Key Counter set is less than the value of the trill release variable (i.e. in case a trill release note of a higher number has been played already as could happen where two release notes are struck simultaneously. If YES (i.e. if the value is less), the program goes to step 736. If NO then step 741 assigns to the trill release variable the value of the trill release note. Step 742 then increments all Key Counters whose trill # is less than or equal to the value of the Trill Release Variable and whose strike # is zero (i.e. if the strike 4 of a key counter were not zero it would mean that the key had been struck but not released and therefore if the key counter setting of the note were incremented it would be given a new release note). The program then goes to step 736 again.

If there is no keystroke for step 736 to process then control is handed to step 743 which determines if any key 2 that has been struck has been released. If step 743 finds information of a key release then step 744 outputs to the synthesizer the appropriate release code 24 along with the pitch value of the released key's Key Counter set. This is followed by step 745 which determines if the trill # of the key that has been released is the same value as that of the variable 'max' ('max' being the number of the highest numbered trill release # of the work) plus 1. If YES (i.e. if the note is not a trill note) then step 751 determines if the value of the note's trill # is one greater than max (i.e. if the note is the last note of the Key Counter and therefore has no note value and the key counter is not incremented on its release). If YES (i.e. it is the Key Counter's last note) then step 752 sends the program to program line 500 (step 735). If NO at step 751 (i.e. the note is not a trill note but not the final note of the Key Counter) then step 747 increments the note's Key Counter after which step 748 sends the program to program line 400 (step 748) in order to highlight the new note of the note's Key Counter, as well as, when necessary, to increment the bar # or the # of the Score Segment. If step 745 determines that the note's trill # is not equal to 'max' (i.e. that the note is a trill note) then step 746 determines if the note's trill # is less than or equal to the value of the Trill Release Variable. If YES (i.e. if the note's trill release note has already been played) then step 747 increments the note's Key Counter after which step 748 sends the program to program line 400 (step 748) where the new Key Counter setting is utilized in the display. If NO (i.e. the note is a trill note but its trill release note has not been played) then step 749 resets the note's strike # to 0 and then step 750 sends the program to program line 500 (step 735).

When there is no Key Release information to be processed at step 743, step 750 checks if there is any input from the switches 3*a,* 3*b,* 4*a,* 4*b,* 5*a,* 5*b,* 6*a* or 6*b.* If NO the program goes to program line 500 (step 735). If YES the program goes to program line 200 (step 705) where, as described above, it determines if there is any input from the WORK+ switch 3*a,* the WORK− switch 3*b,* the SECTION+ switch 4*a,* or the SECTION− switch 4*b.* If the program detects no input from one of these switches it does not go back, via step 722, to program line 200 (step 701), but goes on, via step 721, to program line 600 (step 760).

FIG. 7 shows how, after reaching program line 600 (step 760) the program goes to step 761, which determines whether or not the BAR+ switch 5*a* has been activated. If NO the program goes to step 765, the function of which is described below. If YES step 762 checks to see if the current bar # is less than the selected work's highest bar number. If NO (indicating that the end of the work has been reached) control goes to step 765, the function of which is described below. If YES then step 763 increases the bar number by 1. Step 771 then accesses the Bar # Counter to get the Key Counter settings for the new Bar # and resets the Key Counters. Program control is then sent to program reference point 400 (step 732) the function of which is fully described above.

If step 761 determines that there is no input from the BAR+ switch 5*a,* or that the end of the work has been reached (step 762), then the program goes to step 764, which determines whether or not the BAR− switch 5*b* has been activated. If NO the program goes to step 770, which is described below. If YES then step 765 gets from the Bar # Counter the Key Counter settings for the current bar number. Step 766 determines if these Key Counter settings are the same as the current Key Counter settings. If NO (i.e. if some notes have already been played in the bar) then step 769, the action of which is described in the paragraph above, resets the Key Counters for the current bar number so that the player can play from the beginning of the current bar. If NO step 767 determines if the current bar # is the first bar of the work. If NO then step 768 decreases the Bar # by 1. Then step 769, as described above, sets the work to play from the beginning of the previous bar. If YES (i e. if already at the beginning of the work) program control goes to step 770.

Step 770 determines whether or not the NOTE+ switch 6*a* has been activated.

If step 770 determines that the NOTE+ 6*a* switch has been activated step 771 determines if the lowest numbered note in the Key Counter settings is equal to the total number of notes in the work (i.e. if the current note is the last note in the work). If NO then Step 772 increments the Key Counter whose setting contains the lowest number note. Then at step 773 program control is passed to program reference point 400 (step 732) whose function has been described above. If YES (i.e. if at the end of the work) program control goes to step 774 which is described below.

Step 774 determines if the NOTE− switch 6*b* has not been activated. If NO step 799 sends the program to program line 400 (step 732) which is described above. If YES step 775 determines if the lowest note # in the Key Counter settings is 1. If YES (i.e. already at the beginning of the work) step 799 sends the program to program line 400 (step 732) which is described above. If NO step 776 decreases by 1 the lowest note # in the Key Counter Settings and then gets from the Note # Counter the Key Counter setting for the new note. Step 777 then resets the particular Key Counter after which step 773 clears the buffers and sends program control to program reference point 400 (step 733), the function of which is described above.

Various embodiments of the invention are possible. For example, control of the various settings, i.e. Work, Section #, Bar #, and Note #, could be accessed through the use of a cursor control device such as a computer mouse using a menu or menus displayed on the computer screen. Such an embodiment would obviate the need for means of control for these settings having to be placed on the keyboard. Utilising such a embodiment would enable ten of the keys of a normal electronic keyboard to be used as the keyboard. For individuals wishing to make use of both the keyboard of the invention as well as a traditional keyboard such an embodiment would obviously be convenient.

Alternatively a cursor control device could be situated on and be an integral part of the keyboard.

Alternatively the need for a computer screen 23 could be obviated by utilising musical notation in printed sheet music form. In which case an LCD screen display on the keyboard case could be utilised to provide indications of the various settings. It is quite possible that such an embodiment would provide economies in terms of both space and cost, and of portability. But with the existence of lightweight flat screens the handicap of lack of portability which the normal cathode ray tube computer screen presents can be obviated, though obviously not the cost.

As previously pointed out the invention, as well as enabling a traditional keyboard instrument to be played more easily, can also be utilised to enable the easier playing of any musical instrument that requires fingering to select pitch values. For example, in a conventional woodwind instrument, such as a clarinet, each note is produced by pressing a combination of one or more keys that, via mechanical levers, control the opening and closing of holes on the body of the instrument. The fingerings for some of these notes are quite complicated and a performer must not only learn them but also acquire a considerable degree of skill in order to be able to move quickly (and with the necessary fluency) from one to another.

In adapting such an instrument by use of the present invention the instrument would be provided with only a few keys, two would probably be adequate, which would be connected via a computer 20 to electrically open and close (by means such as solenoids, for instance) the holes in the body of the instrument. Data storage means 21 would inform the computer 20 which holes to open and close to produce the required pitches, thus freeing the player from the sometimes quite demanding manual and mental dexterity required to press those keys in the correct sequence, and thus enabling him or her to concentrate more fully on those other factors affecting the "musicality" of the performance, such as breath control, tone production, rhythm, speed and loudness.

I claim:

1. A system which simplifies the playing of a musical work by effectively reducing a full 88 key keyboard consisting of white and black keys to a keyboard consisting of only ten keys, comprising:

ten keys, each one corresponding to a finger on a hand;

means including the storage of a musical work for assigning a sequence of pitch values for each key, said pitch values being accessible in sequence with each key strike;

a processor connected to said keys and said storage and arranged to provide an output signal to be utilized in the generation of notes in accordance with said sequence of pitch values as accessed by the sequences of corresponding key strikes, said storage containing a set of data associated with each key, each set of data including a predetermined sequence of pitch values to be played one at a time in a sequence corresponding to sequential key strikes of the corresponding key, the arrangement being such that when a key is struck the processor reads an item of data from the data set associated with that key and generates an output signal representing the pitch value at the point in said stored sequence corresponding to when the corresponding key is struck such that repeatedly striking a key causes a series of output signals to be generated that includes the predetermined sequence pitch values associated with repeated striking of the corresponding key, such that when a particular key is struck for the first time, said processor reads the first pitch value of the data set for said predetermined key and causes the associated first pitch to be generated and such that when said predetermined key is struck for a second time, said processor reads the second pitch value of the data set for said predetermined key and causes said second pitch value to be generated, said process continuing until all of the pitch values of said data set have been generated through the successive striking of said predetermined key, whereby the stored work determines the sequence notes to be played by repeated striking of a given key.

2. An instrument according to claim 1, the arrangement being such that when a key is released an output signal is generated indicating that the note generated by striking the key has been terminated.

3. An instrument according to claim 1 or claim 2, in which said output is connected to a sound generating means.

4. An instrument according to claim 1 or claim 2, in which said output is connected to means for controlling the pitch setting of a traditional musical instrument.

5. An instrument according to any one of the preceding claims, in which the loudness of the note to be generated depends on the velocity of the key that has been struck.

6. An instrument according to any one of the preceding claims, in which means are provided for designating a key strike as a trill note.

7. An instrument according to claim 6, in which means are provided for designating a key strike as a trill release note.

8. An instrument according to any one of the preceding claims, in which means are provided for indicating that a particular key strike does not represent an audible note.

9. An instrument according to any one of the preceding claims, in which the processor means is arranged to receive signals from other input devices.

10. An instrument according to any one of the preceding claims, in which the data set associated with each key includes data values indicating the location of each key strike within a musical work.

11. An instrument according to any one of the preceding claims, including means for moving forwards and backwards through the musical work.

12. An instrument according to any one of the preceding claims, including means for displaying the score of a musical work.

13. An instrument according to claim 12, in which the display means is arranged to advance automatically as the player progresses through the work.

14. An instrument according to claim 12, in which the display means includes first and second display areas and is arranged to display consecutive segments of the musical score alternately in said first and second areas as the player progresses through the work.

15. An instrument according to any one of claims 12 to 14, in which the display means includes means for highlighting the next notes to be played.

16. An instrument according to any one of the preceding claims, in which said keys are arranged in two groups of five keys each.

17. An instrument according to claim 16, in which the two groups of keys are angled relative to one another.

* * * * *